US009499949B2

(12) United States Patent
Kline

(10) Patent No.: US 9,499,949 B2
(45) Date of Patent: Nov. 22, 2016

(54) SANDER BODY ATTACHMENT WHICH ACCOMMODATES OPERATION IN CONJUNCTION WITH A TOWED TRAILER

(71) Applicant: Mark Kline, Lonsdale, MN (US)

(72) Inventor: Mark Kline, Lonsdale, MN (US)

( * ) Notice: Subject to any disclaimer, the term of this patent is extended or adjusted under 35 U.S.C. 154(b) by 9 days.

(21) Appl. No.: 14/206,804

(22) Filed: Mar. 12, 2014

(65) Prior Publication Data

US 2014/0263763 A1 Sep. 18, 2014

Related U.S. Application Data

(60) Provisional application No. 61/777,242, filed on Mar. 12, 2013.

(51) Int. Cl.
*E01H 10/00* (2006.01)
*E01C 19/20* (2006.01)

(52) U.S. Cl.
CPC ..... *E01H 10/007* (2013.01); *E01C 19/2005* (2013.01); *E01C 2019/209* (2013.01)

(58) Field of Classification Search
CPC ..... E01C 2019/2085; E01C 2019/209; E01C 19/203; E01C 19/2005; E01C 2019/2095; E01C 19/20; E01H 10/007
USPC ..... 222/610; 239/681, 672, 650, 665
See application file for complete search history.

(56) References Cited

U.S. PATENT DOCUMENTS

| | | | | |
|---|---|---|---|---|
| 2,323,345 | A | 7/1943 | Moore | |
| 2,967,056 | A * | 1/1961 | D Amato | 239/657 |
| 3,072,290 | A * | 1/1963 | De Biasi | 222/23 |
| 3,160,964 | A | 12/1964 | Boyer et al. | |
| 3,393,875 | A | 7/1968 | Bryant, Jr. | |
| 3,438,585 | A * | 4/1969 | Buchmann | 239/665 |
| 3,583,645 | A * | 6/1971 | Murray et al. | 239/657 |
| 4,051,980 | A * | 10/1977 | Vydrzal | 222/610 |
| 4,830,533 | A * | 5/1989 | Miller | E01C 23/06 222/168 |
| 5,108,038 | A | 4/1992 | Palladino et al. | |
| 5,755,387 | A | 5/1998 | Hedrick | |
| 6,336,774 | B1 * | 1/2002 | Dunlop | B60P 1/60 406/151 |
| 6,382,535 | B1 | 5/2002 | Kime | |
| 6,786,435 | B2 * | 9/2004 | Mishra | 239/677 |
| 6,945,482 | B2 * | 9/2005 | Hollinrake et al. | 239/672 |
| 8,028,938 | B2 | 10/2011 | Truan et al. | |
| 2003/0168535 | A1 | 9/2003 | Hollinrake et al. | |

FOREIGN PATENT DOCUMENTS

| | | |
|---|---|---|
| CA | 2050802 | 3/1993 |

* cited by examiner

*Primary Examiner* — Kevin P Shaver
*Assistant Examiner* — Robert Nichols, II
(74) *Attorney, Agent, or Firm* — Craig J. Lervick; Larkin Hoffman Daly & LKindgren, Ltd.

(57) ABSTRACT

In order to allow a truck with the ability to distribute sand to a roadway, while also having the ability to tow accessories, a uniquely configured sander body is provided. The sander body is uniquely adapted for attachment to the truck tailgate, and specifically sized so that it does not interfere with the towing mechanisms of the truck. Further, sander body is also uniquely configured to have a sand distribution chamber, with a removable rear wall, thus allowing easy access for cleaning and maintenance purposes.

16 Claims, 4 Drawing Sheets

SANDER BODY ATTACHMENT WHICH ACCOMMODATES OPERATION IN CONJUNCTION WITH A TOWED TRAILER

BACKGROUND

Certain parts of the world routinely deal with snow and ice covering the roadways. Within these regions plowing/sanding trucks are typically utilized to clear roadways and deposit sand (or other abrasive materials) which helps to provide additional traction for drivers. In certain situations, it is necessary to use these plowing/sanding trucks for additional purposes. One particularly troublesome current situation is where the truck must be capable of plowing and sanding operations, but must also tow a trailer of some type. This is troublesome since the trailer often interferes with the equipment needed to carry out sanding operations.

The removal of snow and ice from roadways is itself often a challenging task. The failure to effectively remove snow and ice creates very hazardous driving conditions, which can ultimately result in accidents and fatalities. Even when a majority of the snow has been removed, any remaining snow or ice creates a hazard. Snowplows are typically equipped with sanding equipment to further minimize this hazard. Consequently, these snowplows have the ability to simultaneously remove snow, and to apply sand, salt or a sand/salt combination to the roadway. Sand alone will help to provide traction, while the application of salt or a salt mixture will promote melting of ice and snow.

Salting and sanding mechanisms have existed for years and typically include a spreader mechanism for distributing sand (and/or salt). Typical spreaders involve a rotational disk which is spun in a desired directed of rotation. Sand or sand salt mixture is then delivered to this spinning disk, which will cast the mixture over a desired area. These delivery mechanisms are typically attached to the rear portion of the sanding truck and will cause the granular material to be spread behind the plowing truck as it progresses along the roadway. Alternatively, a slide chute may be used, which allows sand or other material to simply slide down a sloped surface and be distributed onto the roadway.

As can be imagined, the sanding mechanisms are typically somewhat sizable due to the physical demands and functions carried out. In addition, these mechanisms take up considerable amount of space and typically interfere with the other truck features. Most specifically, these sanding mechanisms typically interfere with hitches and other towing implements. Consequently, the truck itself becomes one dimensional and cannot be used for other functions.

In an effort to more efficiently clear snow and debris from roadways, some plow trucks are also being equipped with towable auxiliary blades. These auxiliary blades can be swung outwardly extending beyond the typical path of the truck itself. In one example, the truck can be driven along a first lane of a highway, while the towable plow blade can extend into a adjacent lane. Similarly, the towable plow may extend onto an adjacent shoulder portion of a highway. In this particular configuration, a single truck can be utilized to clear multiple lanes or multiple portions of the highway itself. By making one path or trip down the highway, multiple lanes are cleared, thus eliminating the need for multiple passes by one truck, or the use of multiple trucks. Naturally, this increases efficiency and reduces cost.

To allow for these towable auxiliary plow blades to be used, a necessary amount of clearance is required. Due to this need for appropriate clearance, sanding mechanisms have not typically been used along with these towable blades. Sanding mechanism require the use of material transfer structures, which are most conveniently located at the rear of the truck. Consequently, these sanding mechanisms typically overlap or cover the hitch mechanisms that exist. There is thus a need for alternative sand handling structures which also allow for towing mechanisms to be used.

SUMMARY

To provide a sanding truck with the ability to plow, sand, and tow accessories (including towing a supplemental tow plow) a uniquely configured sander body is provided. This particular accessory is uniquely configured to be easily attached, while also providing the truck with the ability to distribute sand and avoiding any interference with the towing capabilities of the vehicle. The sander body is attachable to the truck tailgate, in a manner that allows the tailgate/sander body unit to swing or rotate in a well understood manner. Further, the sander body provides a material movement mechanism, allowing sand or a granular mixture to be easily moved towards a delivery location. In addition, the sander body itself is uniquely configured to allow easy cleanout and access to the body interior in an efficient manner. Lastly, the sander body is designed so that it also does not occupying space needed at the rear of the truck to accommodate towing operations.

DESCRIPTION OF THE DRAWINGS

Certain features of the disclosed devices will be further apparent from the consideration of the following drawings in conjunction with the specification, in which.

DESCRIPTION OF THE PREFERRED EMBODIMENTS

Figure 1:
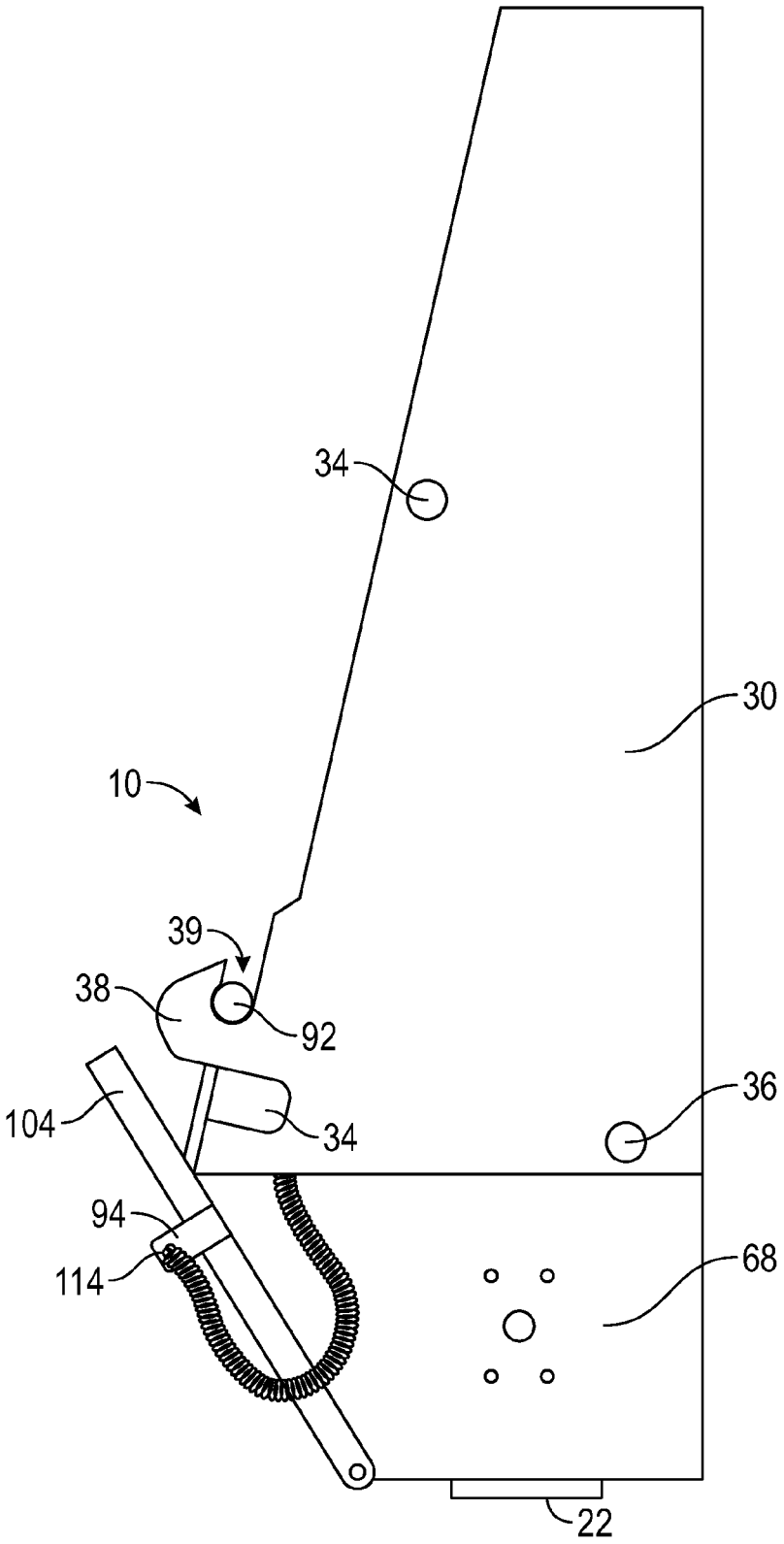
FIG. 1 is a first side view of the sander body apparatus.

In order to allow a typical dump truck to be used for multiple purposes and specifically to simultaneously accommodate plowing, sanding and towing, the mechanisms shown in the figures and discussed below carefully manage the space and dimensions behind a typical dump truck. More specifically, a sander body is configured and oriented to be easily attached to typical dump trucks in a manner which allows sanding material to be easily handled and distributed to appropriate locations, while also staying clear of towing structures.

Referring now to the figures, a sander body attachment 10 includes a main body portion 20 and a pair of attachment sidewalls 30 and 40. The attachment sidewalls 30 and 40 are configured to substantially surround and attach to the tailgate portion 110 of a dump truck 100. (Dump Truck 100 is illustrated in dashed lines in FIG. 4 to show sander body attachment 10 in context.) Once attached, the main body portion 20 will be positioned between the tailgate 110 (which is now extended a slight distance away from the truck box) and a lower floor surface of the truck box itself. In this position, sanding material such as sand or sand/salt mixtures can be easily transferred from the truck box to an open upper portion 50 of the main body portion 20. An auger 60 within main body portion 20 can then transfer sanding material to a delivery location 22. Naturally, alternative mechanisms can be used to transfer or move material to delivery location 22, such as conveyors or movable paddles. Most importantly, the positioning and handling methodology for sander body attachment 10 takes up very little space at the rear of the dump truck 100, thus allowing towing hitches and towing mechanisms 120 to be easily accessible. Based on this configuration, the truck 100 can thus be utilized for both sanding operations, and towing functions.

As mentioned, main body portion 20 is designed to contain an auger 60. To further accommodate efficient operation, a pair of auger guards 62 and 64, exist to shield the portion of the auger 60 that is directly over the delivery location 22. The pair of auger guards 62 and 64 will prevent sand or a sand/salt mixture from falling directly out of an opening which exists at delivery location 22. In addition, the pair of auger guards 62 and 64 help to avoid excess pressure on the auger, and generally promote more efficient operation. It will be understood that auger 60 can be driven by many different drive sources (not shown in the figures), such as an electric motor, hydraulic motor, or some other drive system. In the embodiment illustrated, this drive source could be attached to sidewall 30 at a mounting location 68.

As mentioned above, the sander body 10 is positioned between the tailgate 110 and the box of the dump truck itself. Structures on the sander body 10 allow it to be releasably coupled to the truck box/tailgate 110, in a manner which also allows tailgate 110 to continue operating in a typical manner. Stated differently, this attachment methodology allows the entire structure to be swung outwardly away from the truck box, when the truck box needs to be cleaned and/or emptied.

Figure 2:
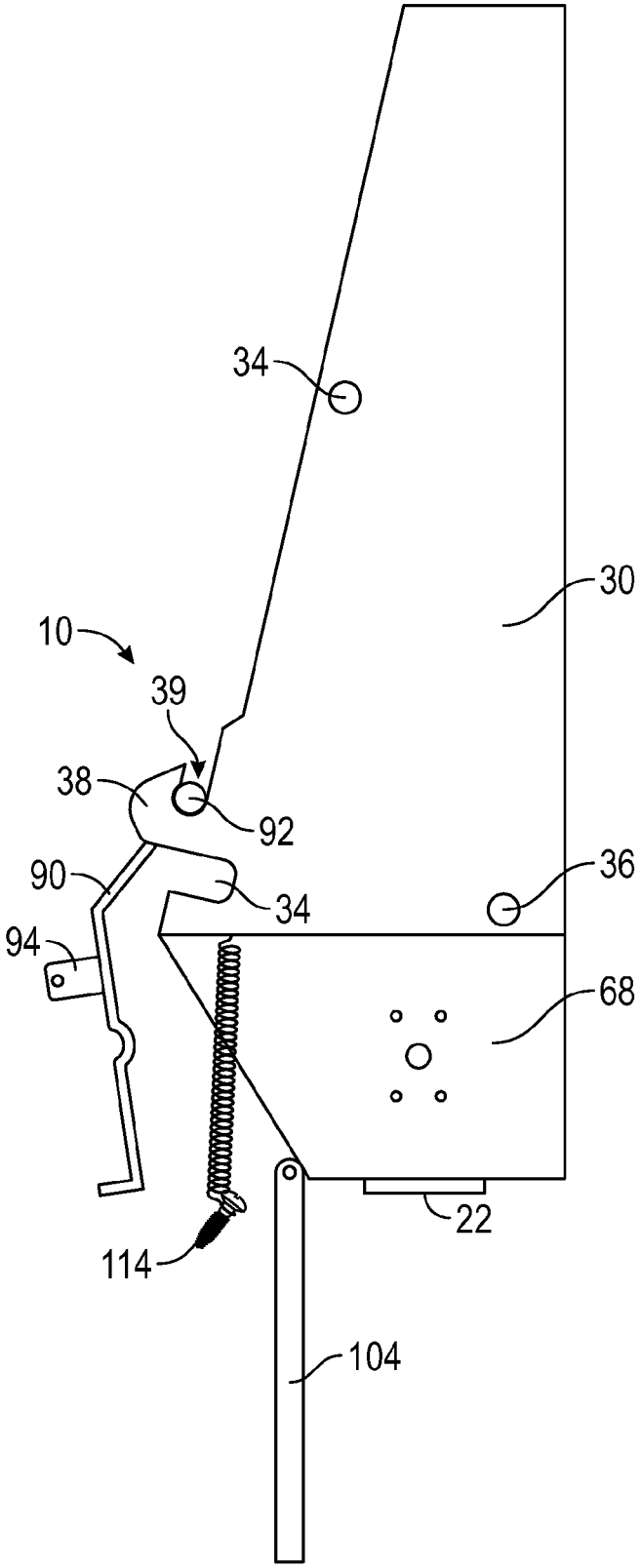
FIG. 2 is a second side view of the sander body attachment, showing removable rear wall in an open position.
Figure 3:
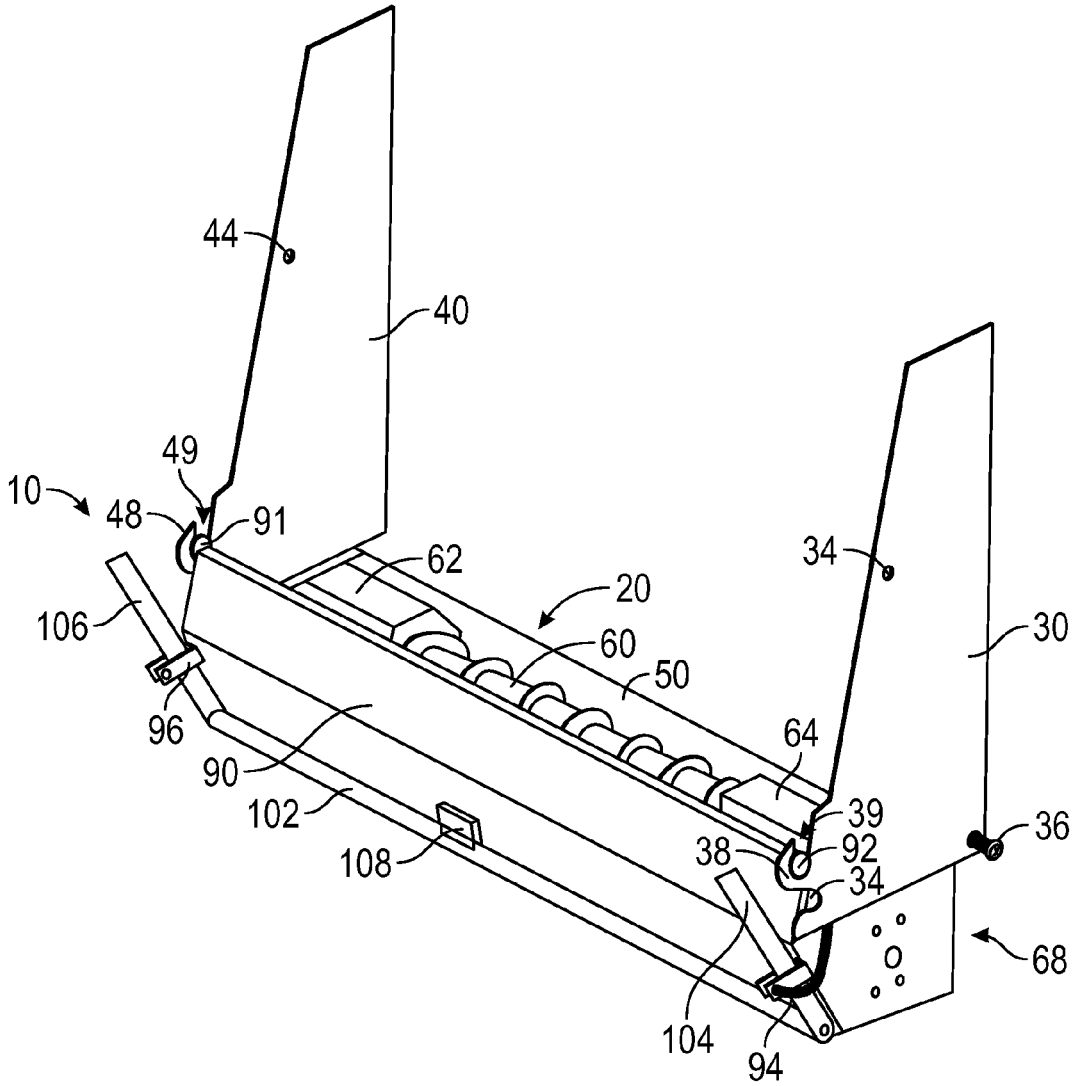
FIG. 3 is a perspective view of the sander body.

As best illustrated in FIGS. 1-3, first sidewall 30 includes a hole or aperture 34 along an outer portion thereof, while second sidewall 40 also includes a similar aperture 44. Each of these features are specifically designed to cooperate with structures on a tailgate 110 when sander body attachment 10 is attached thereto. As is well known, tailgate 110 will attach to the truck at a pair of hinge points 112 (See, FIG. 4). Hinge points 112 are commonly configured as pins or rods, allow tailgate 110 to easily swing or rotate upwardly/outwardly when the box of the dump truck is raised.

Tailgate 110 also includes a pair of holes or apertures along a sidewall thereof (not shown). These sidewall holes are added to the tailgate to accommodate attachment of sander body 10. First aperture 34 and second aperture 44 within the sidewalls (30 and 40) are specifically positioned to be aligned with the tailgate apertures. In this manner, a first pin 114 and a second pin 116 can be positioned within both apertures, to secure sander body attachment 10 to tailgate 110.

As recognized by those familiar with sanding trucks, the tailgate 110 will typically include a locking mechanism to keep the tailgate in a closed position until it is desired to dump material from the box. This locking mechanism generally includes pins attached to tailgate 110, and a coupling mechanism attached to adjacent walls of the dump truck. In order to hold the tailgate in place, the coupling mechanism will capture these pins, thus securely holding the tailgate 110 in position. In order to accommodate similar functions, sander body attachment 10 also includes a pair of pins 36 and 46 positioned at a lower portion of first sidewall 30 and second sidewall 40, respectively. These pins are positioned to cooperate with the dump truck coupling mechanism in exactly the same way similar pins (which are attached to tailgate 110) are captured. In this manner, the same swinging/dumping operation can be achieved for the dump truck itself, even when sander body attachment 10 is mounted thereon.

To further couple the sander body attachment 10 to tailgate 110, first sidewall 30 includes another aperture or slot 34 which is specifically designed to surround the locking pins which currently exist on tailgate 110. As best illustrated in FIGS. 1 & 2, the tailgate pin can be inserted into aperture 34 and the closure of a removable rear wall 90 will capture or hold the tailgate pin in place.

As mentioned above, aperture 34 is specifically designed to capture the tailgate pin. Again, this is made possible due to the design of the removable rear wall 90. As shown in FIGS. 1-3, sidewall 30 includes a receiving hook 38, which forms receiving slot 39. Removable rear wall 90 includes a pair of cooperating extensions 91 and 92 at upper and outer edges thereof. As will be appreciated, extensions 91 and 92 can be easily dropped into receiving slots 39 and 49 to rotatably hold removable rear wall 90. As further illustrated, removable rear wall 90 is rotatable about the axis formed by extensions 91 and 92. In FIGS. 1 and 3, removable rear wall 90 is rotated to a closed or captured position, thus creating an enclosed chamber for sander body 10. Removable rear wall 90 can also be rotated to an open position, as best illustrated in FIG. 2.

Removable rear wall 90 also includes a first connection structure 94 and a second connection structure 96. As further discussed below, first connection structure 94 and second connection structure 96 are specifically configured to cooperate with a first locking handle 104 and a second locking handle 106. By having a removable rear wall 90 which is rotatable in the manner described above, operators can easily open the chamber formed within sander body 10 at any point in time, to perform maintenance, cleaning, or dislodge any obstructions that may exist. The rotatable or hinged connection of removable rear wall 90, along with its overall design, will help to naturally open this component. The orientation illustrated in FIG. 2 shows the natural hanging orientation of removable rear wall 90, when unlatched and with the truck box is in its down position. Obviously, tilting the truck box up will cause removable rear wall 90 to swing out further. As will be appreciated, having the removable rear wall 90 hang in this open orientation will more easily accommodate opening by the operator, since lifting or forcing is not necessarily required.

As best illustrated in FIG. 3, first locking handle 104 and second locking handle 106 are attached on opposite ends of a rotatable bar 102. This rotatable bar 102, coupled with first locking handle 104 and second locking handle 106 allows for a removable rear wall 90 to be captured and held in a closed position when desired. To further accommodate this feature, a holding tab 108 is also attached to rotatable bar 102. As will be clearly appreciated by those skilled in the art, first locking arm 104 and second locking arm 106 are rotatable between an open position (shown in FIG. 2) and a locking position, shown in FIGS. 1 and 3. When in the locking position, first locking handle 104 is received within first connection structure 94. A locking pin 114 can then be inserted to capture first locking handle in its locked position. A similar relationship is achieved with second locking handle 106, second connection structure 96, and a second locking pin 116. When in this locked position, holding tab 108 also provides additional holding forces to keep rotatable rear wall 90 in a closed position.

Figure 4:
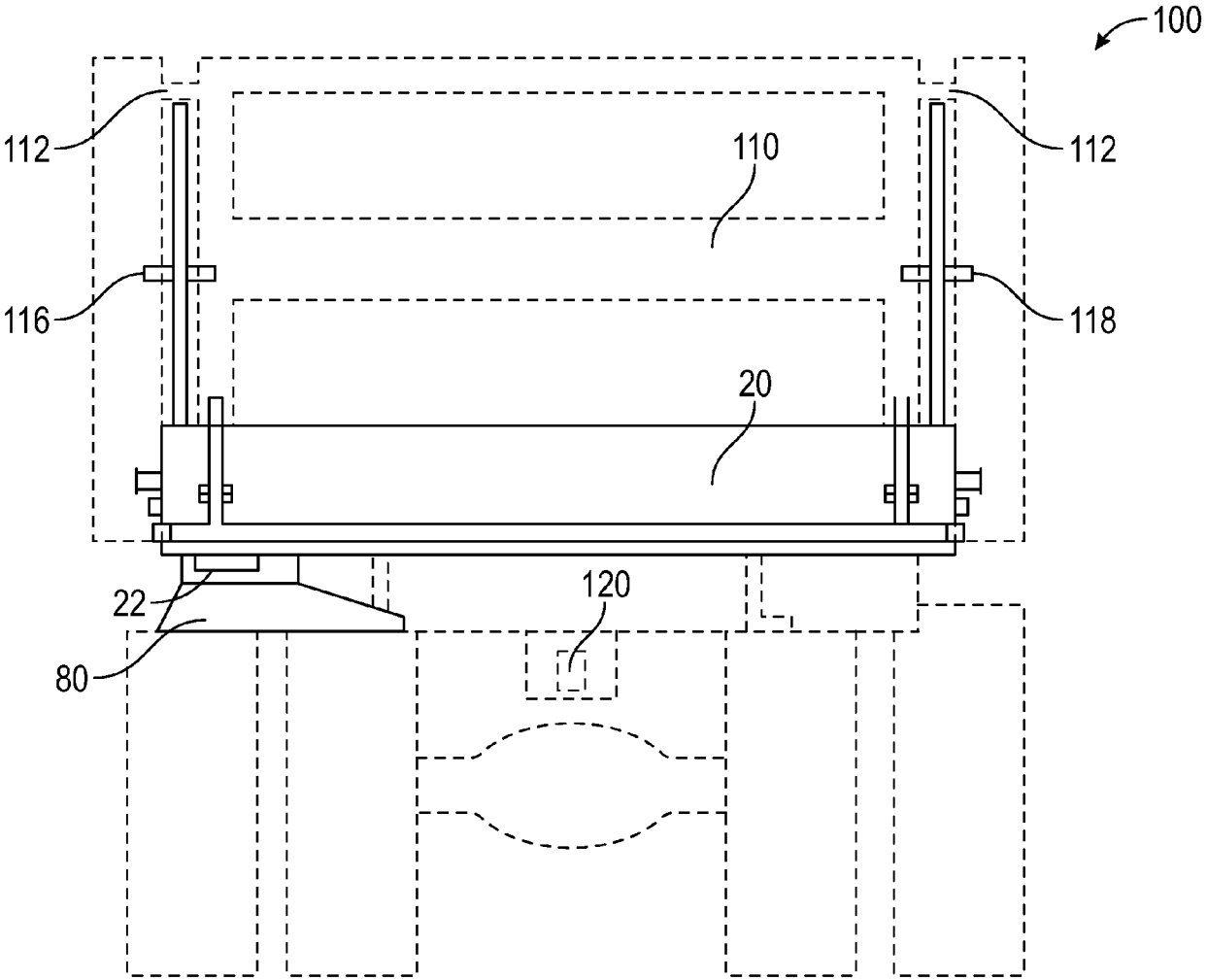
FIG. 4 is the rear view of a sanding truck, illustrating the sander body attachment coupled thereto.

Referring now to FIG. 4, the alignment and orientation of multiple components is better illustrated. Most significantly, main body 20 of sander body attachment 10 is shown, being coupled with tailgate 110 as discussed above. Delivery location 22, in this particular embodiment, is shown at a left hand side of the truck 100. It is noted that delivery locations could be positioned on the left side, right side or both, using the sander body attachment 10. By simply configuring appropriate opening, along with an appropriately configured auger these changes are easily accommodated. Positioned below delivery location 22 is a deliver mechanism 80. This particular embodiment, delivery mechanism 80 is configured as a slide chute 80, which is specifically designed to allow sand, or whatever material is being distributed, to slide down a sloped surface and be dropped upon the desired locations of the roadway. Naturally, several other distribution mechanisms could be utilized.

Most significantly, FIG. 4 illustrates how hitch mechanism 120, positioned at a central location, is a significant distance away from delivery mechanism 80. In this manner, the towing functions of the dump truck itself can continue to be utilized, even when sanding operations are contemplated. Further, sander body attachment 10 is held a meaningful distance above the hitch mechanism 120, to further avoid interference. Due to this spacing and orientation, sander body attachment 10 will not interfere with the towing capabilities of the dump truck, even when the truck box is tilted to an extended operational height. In fact, the sander body attachment 10 is specifically designed to avoid interference even when the truck box is elevated to its normal working height, or any height expected to be used when trailers or accessories are attached. Again, this capability is achieved by having sander body attachment 10 be configured and sized to avoid interference and to efficiently use space behind the dump truck. As generally discussed above, this accommodates additional functionality, including the specific use of towed plow implements.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated.

The various embodiments described above are provided by way of illustration only and should not be construed to limit the claims attached hereto. Those skilled in the art will readily recognize, after reading this disclosure, that various modifications and changes may be made without following the example embodiments and applications illustrated and described herein, and without departing from the true spirit and scope of the following claims.

The invention claimed is:

1. A sander body providing a dump truck with the ability to simultaneously operate in a multi-function manner including sanding and towing functions when the sander body is coupled to a truck box and a swinging tailgate of the dump truck, the truck box being positionable between a horizontal position and an inclined position wherein material is gravitationally shiftable toward a rear end of the truck box, the dump truck having a tow hitch below the swinging tailgate, thereby allowing for the transfer of the material to a delivery location during sanding operations, the sander body comprising:

a housing having a main body and a pair of attachment sidewalls, the main body having a trough structure with a substantially open top portion, each of the attachment sidewalls having a first attachment mechanism and a second attachment mechanism for coupling the housing to the tailgate, the first attachment mechanism being attachable to a sidewall portion of the swinging tailgate, and the second attachment mechanism being attachable to a lock pin portion of the swinging tailgate;

a set of lock pins extending from a lower portion of the housing configured to interact with a locking mechanism on the truck box; and an auger housed within the main body of the housing for moving material to the delivery location for subsequent distribution during sanding operations, wherein the main body is sized so that a bottom portion of the main body is positioned above a trailer hitch carried by the dump truck;

wherein the substantially open top portion of the main body of the housing is positioned between the truck box and the tailgate during sanding operations and the tow hitch is adapted to receive a towing accessory along an insertion axis, the sander body avoiding interference with the insertion axis when the truck box is in the horizontal position, the inclined position or therebetween.

2. The sander body of claim 1 wherein the first attachment mechanism includes pins which extend from the sidewalls and into holes in the tailgate.

3. The sander body of claim 1 wherein the delivery location is on a side of the trough portion.

4. The sander body of claim 1 wherein the housing further comprises a rotatable rear wall portion hingedly forming a rear portion of the main body, the rotatable rear wall configured to be rotated between an open position which allows access to the trough structure and the auger, and a closed position which maintains a closed space within the trough structure.

5. The sander body of claim 1 wherein the dump truck has a clearance distance between a bottom surface of the truck box and the trailer hitch, and wherein the open top portion and the bottom portion of the main housing are separated a distance which is less than the clearance distance.

6. The sander body of claim 1 wherein the first attachment mechanism includes bolts which extend from the sidewalls and into holes in the tailgate.

7. A sander body which is attachable to the tailgate of a sanding truck having a tow hitch positioned below the tailgate and which can be captured by a tailgate capture mechanism on the sanding truck to thereby provide sanding capabilities, the sanding truck having a truck box that is positionable between a horizontal position and an inclined position wherein material is gravitationally shiftable toward a rear end of the truck box, the sander body comprising:

a housing having a main body and a pair of attachment sidewalls, the main body having a substantially open top portion and the sidewalls extending upwardly therefrom, each of the sidewalls having a first attachment mechanism and a second attachment mechanism for coupling the housing to the tailgate, the first attachment mechanism being attachable to a sidewall portion of the swinging tailgate, and the second attachment mechanism being attachable to a lock pin portion of the swinging tailgate, wherein the main body further comprises a removable rear wall rotatably attached thereto which allows access to an interior portion of the housing;

at least one locking pin extending from the housing and positioned to interact the tailgate capture mechanism such that the sander body can be releasably captured by the sanding truck; and a material moving mechanism contained within the housing to move a sanding material to a delivery location of the housing;

wherein:

the substantially open top portion of the main body of the housing is positioned between the truck box and the tailgate during sanding operations, thus allowing the open top portion to receive material from the truck box during use;

the body is sized such that a bottom portion of the main body is positioned above the tow hitch by a predetermined distance, thus allowing continued use of the tow hitch during sanding operations; and the tow hitch is adapted to receive a towing accessory along an insertion axis, the sander body avoiding interference with the insertion axis when the truck box is in the horizontal position, the inclined position or positions therebetween.

8. The sander body of claim 7 wherein the first attachment mechanism includes a hole in the sidewall which is substantially aligned with a corresponding hole in the tailgate, and a pin which extends through the aligned holes, and the second attachment mechanism comprises and aperture in the sidewalls to receive and capture a tailgate pin.

9. The sander body of claim 7 wherein the delivery location is on a side of the main body.

10. The sander body of claim 7 wherein the rotatable rear wall forms a rear portion of the main body, the rotatable rear wall configured to be rotated between an open position which allows access to an interior of the main body and the transfer mechanism, and a closed position which maintains a closed space within the main body.

11. The sander body of claim 10 wherein the rotatable rear wall rotates about an axis which is adjacent the open top portion.

12. The sander body of claim 7 wherein the dump truck has a clearance distance between a bottom surface of the truck box and the tow hitch, and wherein the open top portion and the bottom portion of the main housing are separated a distance which is less than the clearance distance.

13. The sander body of claim 7 wherein the material moving mechanism is an auger.

14. The sander body of claim 7 wherein the material moving mechanism is a conveyor.

15. The sander body of claim 7 wherein the first attachment mechanism includes a hole in the sidewall which is substantially aligned with a corresponding hole in the tailgate, and a bolt which extends through the aligned holes, and the second attachment mechanism comprises and aperture in the sidewalls to receive and capture a tailgate pin.

16. A sander body which is attachable to the tailgate of a sanding truck having a tow hitch positioned below the tailgate and which can be captured by a tailgate capture mechanism on the sanding truck to thereby provide sanding capabilities, the sanding truck have a truck box that is positionable between a horizontal position and an inclined position wherein material is gravitationally shiftable toward a rear end of the truck box, the sander body comprising:

a housing having a main body, a pair of attachment sidewalls attached thereto, and a removable rear wall rotatably attached thereto, the main body, attachment sidewalls and removable rear wall forming an enclosed portion having an open top, sidewalls extending upwardly therefrom with each of the sidewalls having a first attachment mechanism and a second attachment mechanism for coupling to the tailgate, wherein the first attachment mechanism includes a hole in the sidewall which is substantially aligned with a corresponding hole in the tailgate, and a pin which extends through the aligned holes, and the second attachment mechanism comprises and aperture in the sidewalls to receive and capture a tailgate pin, wherein the sander body is allowed to swing with the tailgate when attached;

at least one locking pin extending from the housing and positioned to interact the tailgate capture mechanism such that the sander body can be releasably captured by the sanding truck; and an auger contained within the housing to move a sanding material along the interior portion to a delivery location of the housing;

wherein:

the substantially open top portion of the main body of the housing is positioned between the truck box and the tailgate during sanding operations, thus allowing the open top portion to receive material from the truck box during use;

the body is sized such that a bottom portion of the main body is positioned above the tow hitch by a predetermined distance; and the tow hitch is adapted to receive a towing accessory along an insertion axis, the sander body avoiding interference with the insertion axis when the truck box is in the horizontal position, the inclined position or positions therebetween.

* * * * *